United States Patent [19]

Friberg

[11] Patent Number: 4,968,208

[45] Date of Patent: Nov. 6, 1990

[54] TRANSPORTING ARRANGEMENT FOR TRANSPORTING MOTOR VEHICLES

[75] Inventor: Harry Friberg, Löddeköpinge, Sweden

[73] Assignee: Stig Eliasson, Stockholm, Sweden

[21] Appl. No.: 223,786

[22] PCT Filed: Dec. 8, 1987

[86] PCT No.: PCT/SE87/00583

§ 371 Date: Jul. 26, 1988

§ 102(e) Date: Jul. 26, 1988

[87] PCT Pub. No.: WO88/04350

PCT Pub. Date: Jun. 16, 1988

[30] Foreign Application Priority Data

Dec. 9, 1986 [SE] Sweden ..... 8605279
Sep. 29, 1987 [SE] Sweden ..... 8703756

[51] Int. Cl.[5] ..... E04H 6/18
[52] U.S. Cl. ..... 414/256
[58] Field of Search ..... 414/232, 239, 240, 253, 414/255, 256, 259, 260, 429

[56] References Cited

U.S. PATENT DOCUMENTS 2,899,087 8/1959 Jacobsen ..... 414/256 X
2,916,166 12/1959 Bigler ..... 414/256
2,963,180 12/1960 Sanders ..... 414/256 X
3,156,366 11/1964 Shutt ..... 414/256

FOREIGN PATENT DOCUMENTS 241938 11/1962 Australia ..... 414/255
1167510 4/1964 Fed. Rep. of Germany ..... 414/256
1154661 4/1958 France .
1294277 12/1962 France .
627742 11/1961 Italy ..... 414/256
451612 10/1987 Sweden .
825213 12/1959 United Kingdom ..... 414/256
1497147 1/1978 United Kingdom .

*Primary Examiner*—David A. Bucci
*Attorney, Agent, or Firm*—Nies, Kurz, Bergert & Tamburro

[57] ABSTRACT

A vehicle transporting arrangement, primarily intended for private cars, whereby a vehicle is intended to be transported to a parking space in a vehicle parking building without the assistance of a driver and without the vehicle being rolled on its wheels. According to the invention the transporting arrangement comprises eight lifting blocks (101–108) which are intended to be placed in pairs on both sides of a vehicle wheel. The lifting blocks (101–108) are intended to lift all wheels of the vehicle free from a supporting surface (111). Each lifting block includes a wheel or like device intended for rolling against the supporting surface (111) when the vehicle is in a raised position. The four pairs of lifting blocks (101, 102; 103, 104; 105, 106; 107, 108) are arranged for movement relative to one another, wherein two lifting block pairs (101, 102; 103, 104) are included in a first lifting unit (200) and wherein two lifting block pairs (105, 106; 107, 108) are included in a second lifting unit (201). The two units can be displaced relative to one another, whereby each of the respective lifting block pairs can be moved to a position adjacent a respective wheel of the vehicle such that the two lifting blocks in each respective pair are located on both sides of a respective vehicle wheel when a vehicle has been placed in a pre-determined position relative to the transporting arrangement.

8 Claims, 4 Drawing Sheets

TRANSPORTING ARRANGEMENT FOR TRANSPORTING MOTOR VEHICLES

BACKGROUND OF THE INVENTION

The present invention relates to a transporting arrangement for transporting motor vehicles, particularly private cars, in connection with motor vehicle parking buildings in which the vehicle is moved to a parking space without the assistance of a driver.

One such motor vehicle transporting arrangement is described in Swedish Pat. Specification No. 8500791-2.

The present motor vehicle transporting arrangement is intended for use in vehicle parking buildings in which a vehicle to be parked is transported, in horizontal and vertical directions, from the ground floor of the car park to an empty parking space therein, without the assistance of a driver and without using the vehicle wheels to roll the car. Such parking buildings are previously known, where each floor of the parking building is divided into a multiple of mutually adjacent vehicle parking spaces.

A particular advantage is afforded when such vehicle parking buildings are totally unmanned or are only partially manned. In this case, the vehicle is driven to a predetermined position in relation to the arrangement, and the requisite parking fee is paid into a parking meter, which in response issues a card or like receipt which, in addition to other information, discloses the location of a conceivable parking space in the building in which the parking facility is found. The arrangement includes a computer which is capable of finding an empty parking space with the aid of sensors, and of causing the car to be moved to said space. When collecting the vehicle, the card or like receipt is inserted into a card reader and the computer, subsequent to payment being made, controls the collection of the vehicle from its parking space.

As reported in the aforesaid Swedish Patent Specification, one serious problem encountered with vehicle parking arrangements of this kind resides in the difficulty of locking the vehicle relative to the transporting arrangement in a simple manner, without the assistance of a manual work. This problem is accentuated by the fact that different cars have different tracks or gauges, and different axle heights.

Another problem encountered with known vehicle transporting arrangements is that they have a considerable vertical extension, and consequently a considerable part of the vertical space in a vehicle parking building is occupied by the transporting arrangement and the various devices incorporated therein. Another problem with known vehicle parking arrangements of this kind is that the driver of the vehicle to be parked is required to position the vehicle accurately in both its longitudinal and its transverse directions.

The present invention affords a solution to these problems.

SUMMARY OF THE INVENTION

Thus, the present invention relates to a motor vehicle transporting arrangement, primarily intended for parking private cars, by means of which a motor vehicle is transported to a parking space in a vehicle parking building without the assistance of a driver and without rolling the vehicle on its wheels, said transporting arrangement being characterized in that it includes eight lifting blocks which are intended to be positioned in pairs on respective sides of a vehicle wheel and which are constructed to raise all of the vehicle wheels from a supporting surface, such as a floor surface, and each of which lifting blocks includes a roller or like device which is intended to roll against said support surface when the vehicle is in a raised position; in that the four pairs of lifting blocks are displaceable relative to one another; in that two pairs of blocks are included in a first lifting unit and two pairs of lifting blocks are included in a second lifting unit, said units being displaceable relative to one another such that each of the respective pairs of lifting blocks can be brought to a position in which they are located adjacent a respective vehicle wheel and in which the two blocks of each pair of blocks are located on a respective side of said each vehicle wheel subsequent to placing a vehicle in a pre-determined position relative to the transporting arrangement.

SPECIFIC DESCRIPTION OF THE DRAWING

The invention will now be described in more detail with reference to exemplifying embodiments thereof illustrated in the accompanying drawings, in which FIG. 1 illustrates an inventive vehicle transporting arrangement in plan view;

GENERAL DESCRIPTION OF THE EMBODIMENTS

Figure 1:
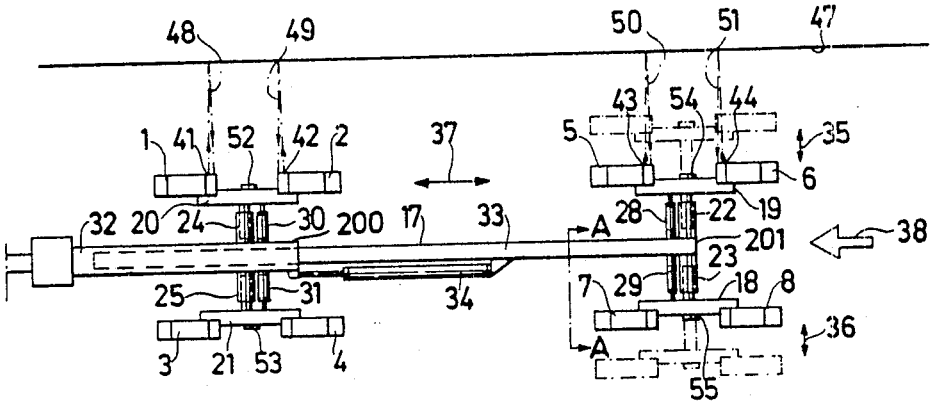

FIG. 1 illustrates in plan view a first embodiment of an inventive vehicle transporting arrangement.

Figure 5:
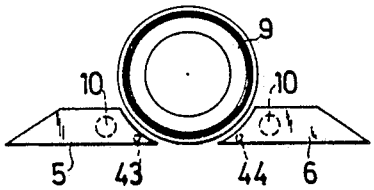
FIG. 5 shows two lifting blocks positioned on respective sides of a vehicle wheel.
Figure 6:
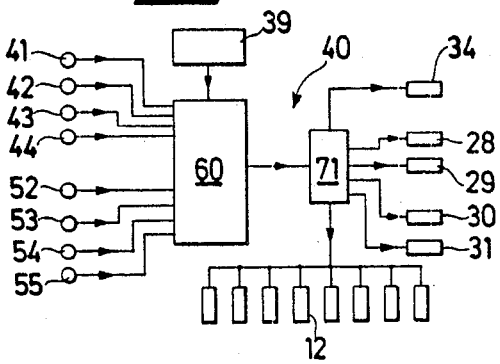
FIG. 6 is a schematic block diagram of a control circuit.

The transporting arrangement comprises eight lifting blocks 1–8, which are arranged in pairs, 1, 2; 3, 4; 5,6; 7, 8, the lighting blocks of each pair of blocks being intended to be positioned on respective sides of a vehicle wheel 9, as illustrated in FIG. 5.

Figure 4:
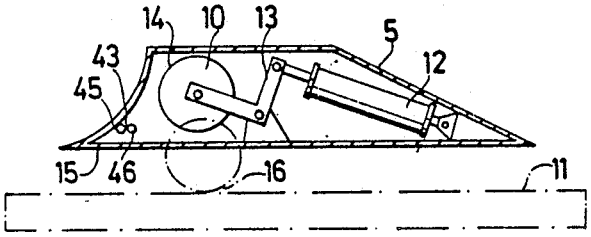
FIG. 4 illustrates a lifting block in larger scale.

The blocks 1–8 are each provided with a lifting arrangement for raising the blocks, and therewith all wheels of the vehicle, from a supporting surface, such as a floor surface. As illustrated in FIG. 4, the lifting arrangement includes a wheel or a roller 10 which is intended to roll against the supporting surface 11 when the vehicle is in a raised position. According to one preferred embodiment, the roller 10 of each of the lifting blocks can be moved by means of a hydraulic cylinder 12 or like device and by means of link arms 13 located on respective sides of the roller, the roller 10 being journalled in said link arms. Thus the roller 10 can be moved between a position indicated at 14, in which the lowermost surface of the roller 10 is raised above the lower surface 15 of its associated lifting block 1–8, and a position indicated at 16 in which the roller 10 projects down out of the lifting block, such that the lowermost surface of the roller is located beneath the lower surface 15 of the lifting block. In this latter position the lifting block is thus raised above said supporting surface 11, this supporting surface being either a floor surface, a supporting ramp or some like support.

The four pairs of lifting blocks 1, 2; 3, 4; 5, 6; 7, 8 are pairwise displaceable relative to one another, wherein two pairs of lifting blocks 1, 2; 3, 4; are included in a first lifting unit 200, and wherein two pairs of lifting blocks 5, 6; 7, 8 are included in a second lifting unit 201, these units being displaceable in relation to one another.

The two lifting blocks of each pair of lifting blocks are mutually connected by means of beams 18–21.

The two respective lifting units 200, 201 are attached to a first arm 17 wherein each pair of lifting blocks is individually displaceable towards and away from its respective arm 17 in a direction transversely to the longitudinal axis of said arm 17.

According to one preferred embodiment each pair of lifting blocks is attached to said first arm 17 by means of a second respective arm 22–25. Each of said second arms 22–25 includes a first and a second part 26, 27 which are telescopically moveable relative to one another. The parts 26, 27 can be moved by means of a pneumatic cylinder 28–31 or the like, said device being connected between the outer part 27 of the telescopic second arm 26,27 and said first arm 17. The first arm 17 also comprises first and second parts 32, 33 which are telescopically moveable relative to one another. The first lifting unit 200 is connected to the first part 32 of the arm 17, whereas the second lifting unit 201 is connected to the second part 33 of the arm, as illustrated in FIG. 1.

The two parts 32, 33 of the first arm 17 can be displaced in relation to one another by means of a pneumatic cylinder 34 or some like device.

The first arm 17 and the second arms 22–25 conveniently comprise two square-beams which will fit one into the other and which are provided with wheel bearings or slide bearings for the telescopic movements.

It will be understood clearly from the aforegoing that each of the respective pairs of lifting blocks can be displaced by means of the arms 17, 22–15 to a location adjacent a respective vehicle wheel, such that the two lifting blocks of each pair of blocks is positioned on a respective side of said wheel when a vehicle is positioned so that its longitudinal axis is essentially parallel with and above said first arm 17.

An outer position for the two right-hand lifting block pairs 5, 6; 7, 8 is illustrated in chain lines in FIG. 1. The pairs of lifting blocks are thus displaceable in the directions of the arrows 35, 36, and the first arm can be extended and retracted in the manner illustrated by the arrow 37.

The arms are constructed so as to be adjustable to the track or gauge and the axle distance of each intended type of vehicle, preferably private cars, thereby enabling the vehicle transporting arrangement to be adapted to each vehicle per se.

The height of the transporting arrangement is such as to be shorter than the clearance height of a vehicle.

The inventive transporting arrangement operates in the following manner. When the system is in its starting mode, the pairs of lifting blocks are located in their inner positions, i.e. in an end position furthest in towards the first arm, as shown in full lines in FIG. 1. A vehicle is moved in the direction of arrow 38 into and over the transporting arrangement wherewith the driver attempts to steer the vehicle so that it is positioned centrally above the first arm 17. The driver also attempts to stop the vehicle in a pre-determined position, which is indicated with the aid of a signal lamp or some corresponding device, the signals being similar to those used with a number of known automatic car washing systems. The vehicle stop position is selected so that the wheels of the vehicle will be located approximately centrally of the pairs of lifting blocks although the position in which the vehicle is stopped is not at all critical to the function of the transporting arrangement, as will be evident from the following.

A control circuit 40 is then activated such as to cause the transporting arrangement to move the pairs of lifting blocks into their respective positions adjacent the vehicle wheels, this activation being effected, for instance, by means of a suitable device 39.

In order to facilitate this controlled movement of the lifting blocks, at least the two pairs of lifting blocks 1, 2; 5, 6 on one side of the first arm 17 are provided with sensors 41–44 which are intended to sense the presence of a vehicle wheel located on one side of and centrally of a pair of lifting blocks 1, 2; 5, 6.

The sensors 41–44 are connected to said control circuit 40, which is constructed to control the pneumatic cylinder 34 in a manner either to shorten or to extend the first arm 17. These sensors 41–44 conveniently have the form of photocells incorporating a light-emitting device 45 and a light-sensitive device 46, see FIG. 4.

The photocells are preferably arranged to co-act with a reflective screen 47 located at a distance from and parallel with the transporting arrangement, this screen 47 being intended to reflect the light emitted by the photocell back to the photocell, as indicated by the light rays 48–51 in FIG. 1.

Assume that the first part 32 of the arm 17 remains stationary while the second part 33 s moved with the aid of the cylinder 34, backwards and/or forwards, and that a vehicle wheel is located adjacent the right-hand upper pair of lifting blocks 5, 6 in FIG. 1.

When the pair of lifting blocks 5, 6 are moved in direction 37 and the control circuit 40 senses that the light emitted firstly by one photocell and then the other photocell has been screened, which is effected by means of the lower part of the vehicle tire, the control circuit becomes aware that a vehicle wheel has been passed. The control circuit then causes the pair of lifting blocks to be moved in an opposite direction until the light emitted by one photocell is screened and then until said light is no longer screened. The pair of lifting blocks is, in this way, positioned so that the photocells are located at respective sides of the vehicle wheel, as illustrated in FIG. 5.

Figure 3:
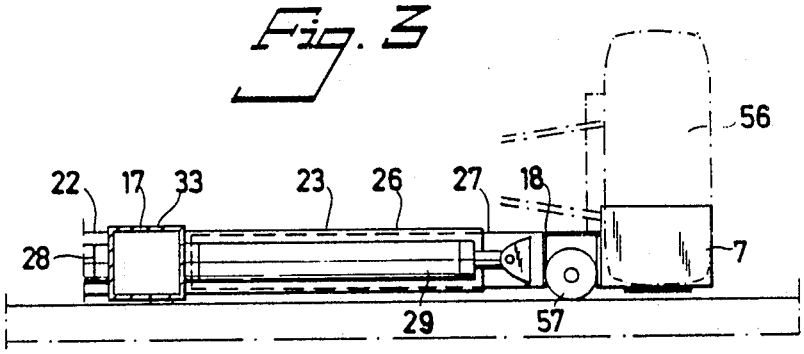
FIG. 3 is a sectional view taken on the line A—A in FIG. 1.

The control circuit 40 then activates the piston-cylinder devices 28, 29 in a manner to position the pairs of lifting blocks 5, 6; 7, 8 on both sides of respective wheels. Each pair of lifting blocks is provided with a sensor 52–55 which is intended to detect when the beams 18–21 of respective pairs of lifting blocks are located close to the lower part of the tire wall of respective vehicle wheels. In this position the two lifting blocks of each pair of blocks are positioned on respective sides of a vehicle wheel (see FIG. 5) and externally of the tread of the wheel 56 (see FIG. 3).

The sensors 52–55 are preferably limit position switches or the like. When a sensor 52–55 is activated, the control circuit is constructed to stop the piston-cylinder device 28-31 associated with the pair of lifting blocks on which the sensor concerned is mounted.

Extension of the outer part 27 of said second arm is facilitated by means of a wheel 57 journalled on the beam 18–21 or on said outer part 27.

In order to facilitate displacement of the pairs of lifting blocks in directions 37, the cylinders 12 of the pair of lifting blocks in question are activated by the control circuit 40 prior to said displacement such as to reach the position 16. As a result hereof the lifting blocks and the beams 18–21 are raised to an extent such as to lift the vehicle wheels 57 from the supporting surface.

In order to position the pairs of lifting blocks 1,2;3,4 on both sides of the two other vehicle wheels, the cylinder 34 is actuated so that said pairs of lifting blocks 1, 2; 3,4 are moved in direction 37, wherewith a wheel on one side of the lifting block pair 1, 2 is localized in the aforedescribed manner. The cylinders 30, 31 are then actuated so as to move the pairs of lifting blocks to their outer positions, in which each of said lifting block pairs is positioned on a respective side of a wheel.

It will be obvious from the aforegoing that a vehicle need only be roughly positioned, since all pairs of lifting blocks are displaceable in two directions.

After all lifting block pairs have been positioned on both sides of a vehicle wheel, the control circuit 40 is arranged to actuate cylinders 12, wherewith the vehicle wheels are lifted from the supporting surface and the transporting arrangement rests against the supporting surface 11 on the rollers 10.

The control circuit conveniently includes a microprocessor 60 of conventional kind which is programmed, inter alia, to control the aforedescribed operational method through a conventional output circuit 71.

When the vehicle has been raised, the transporting arrangement is ready for transporting the vehicle to a parking space. These vehicle transportations will now be described schematically in connection with FIG. 2.

Figure 2:
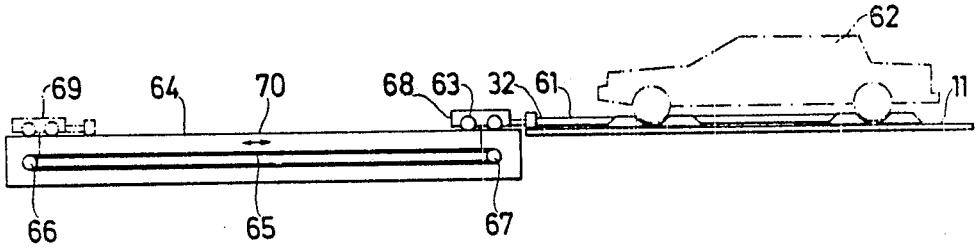
FIG. 2 is a side view of the transporting arrangement and a hoist arrangement.

The aforedescribed transporting arrangement is illustrated schematically in FIG. 2 and is referenced 61. The transporting arrangement 61 carries a car 62. The arm 32 is attached to a carriage 63, or some other suitable towing device, for pulling the transporting arrangement 61 onto a lift arrangement 64. In the FIG. 2 embodiment the carriage 63 is supported on wheels and is attached to a chain 65 which extends between two end wheels 66, 67 such that the carriage can be moved between positions 68 and 69 by means of said chain, which is driven. The carriage 63 is intended to pull the transporting arrangement 61 onto a lift platform 70 and is also intended to push the transporting arrangement 61 from the lift platform onto the supporting surface 11.

The lift arrangement 64 is preferably arranged via devices not shown for both vertical and horizontal movement between different parking areas. When he lift arrangement 64 has been moved to a selected parking space, the transporting arrangement is pushed out to the position illustrated in FIG. 2, such as to rest against a floor surface or the like in said parking space.

The control circuit 40 then causes the cylinders 12 to be moved in a manner to withdraw the rollers 10 into respective lifting blocks and actuates the cylinders 28-31 in a manner to move the pairs of lifting blocks to their respective inner positions. The control circuit 40 then initiates actuation of the carriage 63, such as to draw the transporting arrangement in over the lift platform 70, whereupon the lift arrangement together with the transporting arrangement can be moved to a further vehicle and transport this further vehicle to another parking space.

When a vehicle is to be collected from its parking space, the vehicle is loaded onto the transporting arrangement in the aforedescribed manner, subsequent to moving the transporting arrangement in beneath the vehicle in said parking space. In the aforegoing mention was made of the use of photocells for positioning the lifting blocks. This applied primarily when a vehicle was driven into a given position by a driver.

It will be understood, however, that the arrangement may include conventional sensors (not shown) which disclose the positions of the cylinders 28–31, 34, or similarly the position of the carriage 63 when sensing the location of a vehicle in a parking space. The values produced by said sensors can be stored in a memory facility incorporated in the control circuit. When a given vehicle is to be collected from a given parking space, the control circuit 40 is constructed to extract these values from the memory and therewith actuate the cylinders 28–31, 34 and to guide the carriage to those positions given by the sensors when positioning the vehicle in question in said parking space. This method of operation obviates the need of a screen 47 in each parking space, since the photocells need not be used for positioning the pairs of lifting blocks on both sides of the vehicle wheels.

Although the invention has been described hitherto with reference to one exemplifying embodiment it will be understood that modifications can be made thereto.

For example hydraulic cylinders can be used instead of pneumatic cylinders and the telescopic arms may have a construction different to that described. The lifting blocks may also have a different construction to that described.

Figure 7:
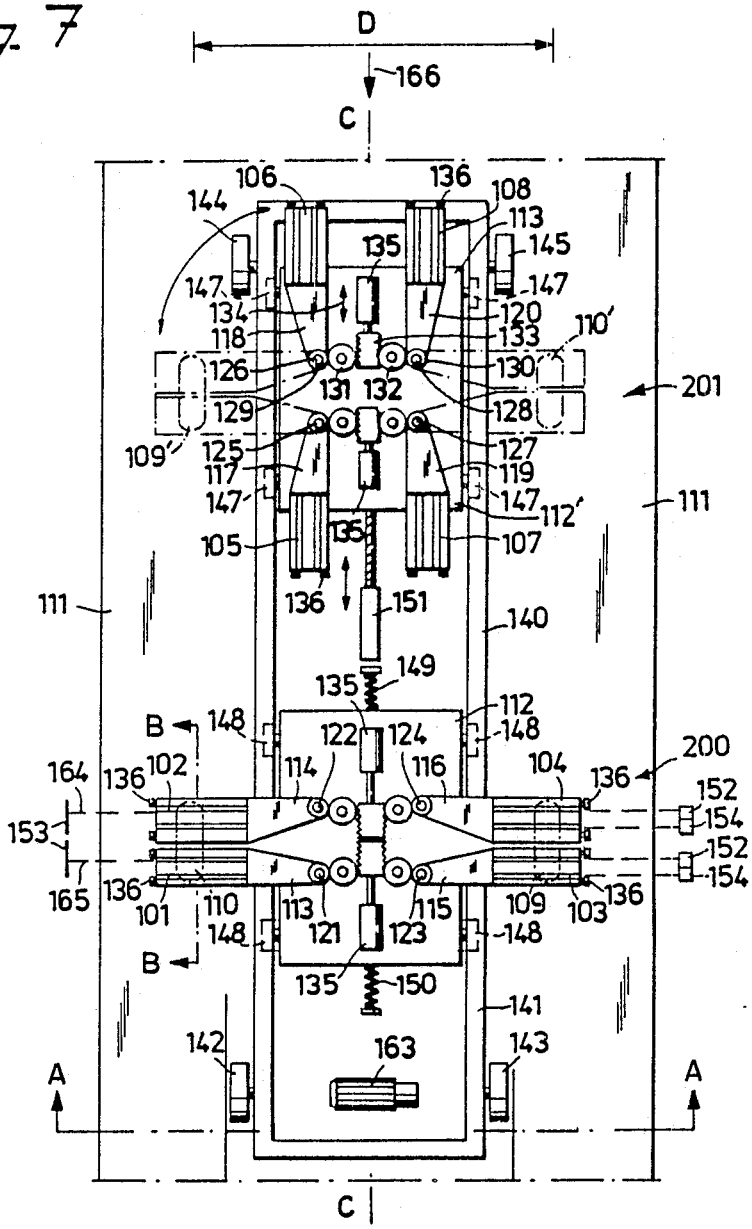
FIG. 7 illustrates a second embodiment of an inventive arrangement in plan view.

FIG. 7 illustrates a second exemplifying embodiment of the transporting arrangement. which also includes eight lifting blocks 101-108 which are intended to be placed in pair on both sides of a vehicle wheel 109, 110 and therewith lift the vehicle wheels 109, 110 from a supporting surface 111, such as a floor surface or a drive ramp.

According to this embodiment of the invention the first lifting unit 200 comprises a first carriage 112 and the second lifting unit 201 comprises a second carriage 112', where a first and a second lifting block pair 101, 102; 103, 104 are attached to the first carriage 112 and a third and a fourth lifting block pair 105, 106; 107, 108 are attached to the second carriage 112'. The carriages are arranged in line, one after the other. A vehicle is intended to be driven in and positioned over the carriage, with one carriage located beneath the front part of the vehicle and the other carriage located beneath the rear part thereof. The vehicle is also intended to be driven along the line C—C in FIG. 7, with said line coinciding with the longitudinal axis of the vehicle in a vertical plane. The vehicle can either be driven to a position above the carriages or can be driven to a predetermined location and the carriages subsequently inserted beneath the vehicle.

Each lifting block 101–108 is attached to one end of an arm 113–120. The other end of respective arms can be swung about an axle 121–128 n respective carriages from an inwardly swung position, illustrated in the upper part of FIG. 7, to an outwardly swung position illustrated in the lower part of FIG. 7.

When the arms occupy their inwardly swung position, the arms and lifting blocks are parallel or substantially parallel with said line C—C. In the outwardly swung position, on the other hand, respective arms and lifting blocks are oriented at right angles or substantially at right angles to said line C—C. In the outwardly swung position, the lifting blocks of each pair of blocks lie close together or alternatively in abutment with one another.

When seen in vertical section (FIG. 9) the lifting blocks have a wedge-shape configuration, such that when the lifting blocks occupy their outwardly swung positions said blocks define an upwardly concave surface. This concave surface has a curvature which corresponds essentially to the curvature of a vehicle wheel.

With this embodiment the lifting blocks of each pair of lifting blocks are arranged to be inserted beneath a vehicle wheel from both sides thereof when moved from their inwardly swung position to their outwardly swung position, therewith lifting said wheel.

The distance between each of the two lifting block pairs of the carriages 112, 112' in the outwardly swung position of said blocks, i.e. the distance D in FIG. 7, corresponds to the track or gauge of a vehicle whose wheels are to be lifted. As will be seen from FIG. 7, and in particular the lifting blocks 101–104, the lifting blocks have a given width which is so adapted as to enable all, or at least the majority of vehicles for which the transporting arrangement is intended to be lifted by said arrangement.

Furthermore, at least one of the carriages 112,112' is arranged for movement in a direction along said line C—C, thereby enabling the arrangement to be adjusted to the axle distance of different vehicles.

Figure 11:
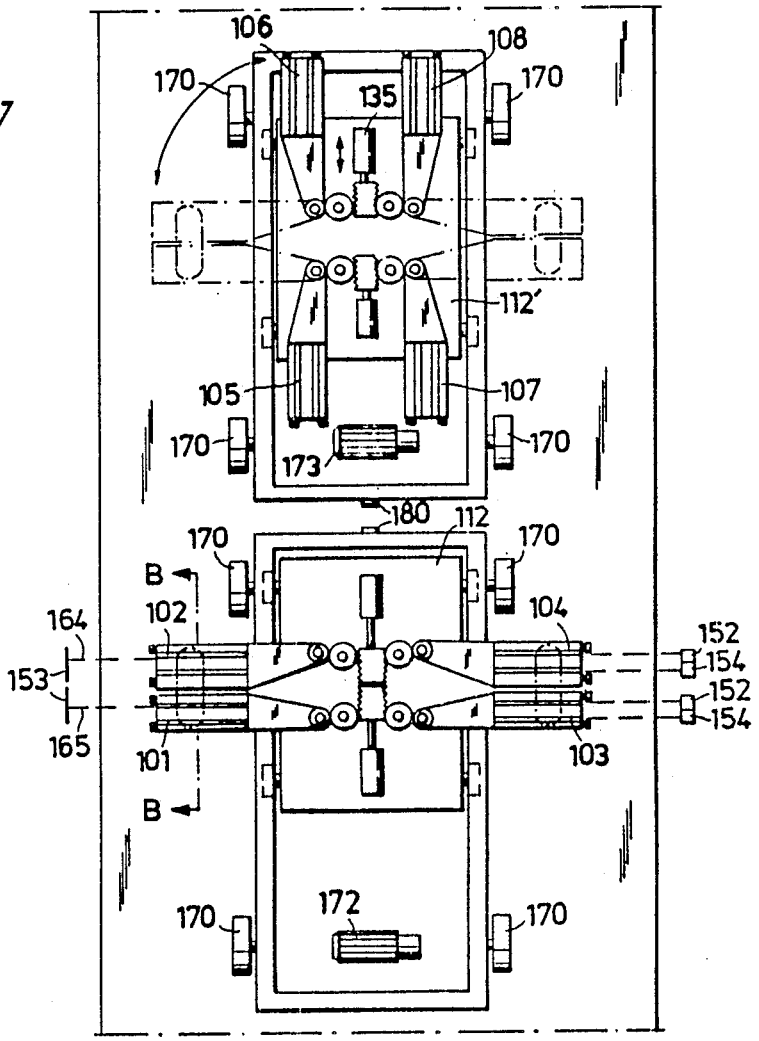
FIG. 11 illustrates a third embodiment of an inventive arrangement seen in plan view.

In the embodiment illustrated in FIGS. 7 and 11, the arms 113–120 has be pivoted about axes 121–128 by means Of a rack and pinion arrangement. With reference to the arms 118 and 120 in FIG. 7, pinions 129, 130 are attached to the axles 126, 128. These pinions 129, 130 co-act with further pinions 131, 132, which in turn co-act with a rack 133. The rack 133 is driven in the direction of arrows 134 by means of a suitable piston-cylinder device 135, such as a hydraulic piston-cylinder device. The piston-cylinder device 135, however, can be replaced with a ball screw driven by an electric motor.

When the rack 133 is driven downwards in FIG. 7, the arms 118, 120 are pivoted such as to move the lifting blocks 106, 108 from their outwardly swung positions, shown in dash and dot lines in FIG. 7. Other arms are arranged for pivotal movement by means of a similar arrangement.

It will be understood that each arm may be instead activated directly by a hydraulic piston-cylinder device, or hydraulic motors can be connected directly to the axles 121–128.

It will also be understood that the illustrated embodiment of the arm drive merely constitutes one of many conceivable embodiments.

In accordance with one preferred embodiment, however, a first lifting block 101, 103; 105, 107 of the two pairs of lifting blocks on one and the same carriage are arranged to be swung out synchronously. The second lifting block 102, 104; 106, 108 of the two pairs of lifting blocks are also arranged to be swung out synchronously.

In accordance with another embodiment, the first lifting blocks 101, 103; 105, 107 of said two pairs of lifting blocks are swung out independently of the second lifting blocks 102, 104; 106, 108, and vice versa.

In accordance with a further preferred embodiment the lifting blocks are provided with wheels 136 which are intended to abut the supporting surface 11 when the lifting blocks are raised above said surface.

Figure 9:
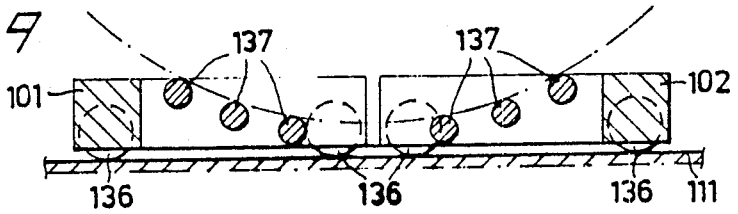
FIG. 9 is a schematic sectional view in larger scale on the line B—B of FIG. 7.
Figure 10:
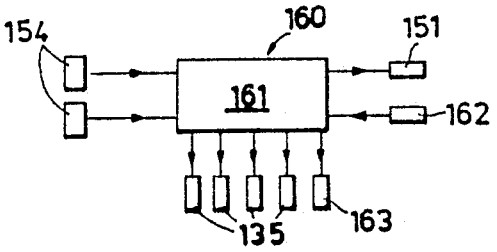
FIG. 10 is a block diagram of a control system.

According to another preferred embodiment, see FIG. 9, the aforesaid concave surface of the lifting blocks is defined by a plurality of rollers 137. The chain line in FIG. 9 denotes the periphery of a vehicle wheel.

Figure 8:
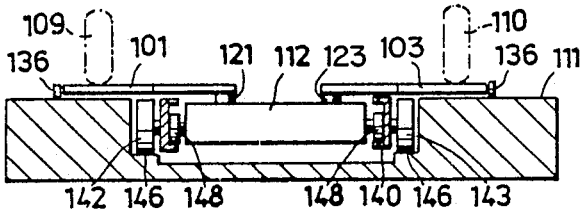
FIG. 8 is a schematic sectional view taken on the line A—A in FIG. 7.

According to a second embodiment of the invention the carriages 112, 112', see FIG. 7, are moveably connected to a common further, third carriage 140', which is intended to transport the vehicle. The third carriage 140 of this embodiment comprises a frame structure 141 which is carried by a plurality of wheels 142-145 which rest on a support surface 146 in the form of rails or like elements. The long sides of the frame structure 140 may have an L-shape when seen in cross section or, as shown in FIG. 8, a U-shape cross section, the wheels 147, 148 of respective carriages 112, 112' resting against said long sides.

In accordance with one preferred embodiment the first carriage 112 is arranged for limited movement relative to the third carriage 140. Preferably, the carriage can be moved in both directions from a neutral position through a distance of approximately 50 cm. The neutral position is shown in FIG. 7. The carriage 112 is preferably held in the neutral position in relation to the third carriage 140 by means of springs 149, 150.

In the case of this embodiment the second carriaqe 112' is moved relative to the third carriage 140 by means of a drive device 151, such as an electrically driven ball screw arranged between the second carriage 112' and the third carriage 140.

There is also provided a suitable known positioning arrangement, for example comprising two photocells each including a light source 152, a reflector 153 and a light sensitive element 154. The beam paths 164, 165 of the photocells are, in this case, so positioned as to extend parallel with one another at a distance apart of approximately 50–100 em and only a short distance above the supporting surface 111. When the front wheels of a vehicle are driven to a position in which the wheels are located adjacent the first and second pairs of lifting blocks and are correctly positioned relative to said blocks, a light beam will pass on each side of the wheels, parallel with the front axle of the vehicle.

The light sensitive elements 154 are connected to a control system 160 which includes a control circuit 161, such as a microprocessor for example.

Also connected to the control circuit 161 is a force sensing device 162 which is intended to sense the force exerted by the drive arrangement 151 on the second carriage 112'.

The control circuit 161 also includes control outputs for controlling the four piston-cylinder arrangements 135 which drive the respective lifting block pairs on respective carriages in the aforedescribed manner. The control circuit also includes a control output for activating the drive arrangement 151 and a control output for activating an electric motor 163 arranged for driving the third carriage.

The manner in which the transporting arrangement operates is as follows.

A vehicle is driven in the direction of the arrow 166 such that the front wheels 109, 110 of the vehicle are located in the position for the lifting block pairs 101, 102; 103, 104 of the first carriage. In this stage of the working process, the pairs of lifting blocks 101, 102; 103, 104 occupy their inwardly swung positions. A facility may be provided which co-acts with the photocell arrangement to present on a display screen instructions to drive the vehicle further forward, to reverse the vehicle and/or to stop the vehicle, i.e. in a manner similar to that used in automatic car washing facilities. When the vehicle is positioned correctly, the control circuit 161 activates the two piston-cylinder devices 135 on the first carriage 112, such as to swing the lifting blocks synchronously outwards to their outwardly swung positions, therewith raising the wheels 109, 110 to the position illustrated in FIG. 9.

The second carriage 112' then takes its lowermost position in FIG. 7, i.e. with the ball screw screwed fully into the drive arrangement 151. The first 105, 107 of the lifting blocks are hereafter swung outwardly by the associated cylinder 135, actuated by the control circuit 161. Subsequent to the lifting blocks being swung outwardly in this manner, the control circuit activates the drive arrangement 151 to drive the second carriage upwards in FIG. 7. The control circuit 161 is constructed to stop the drive arrangement 151 when said force sensing device 162 produces a signal which corresponds to a pre-determined force. This force is reached when the lifting block 105, 107 abuts the rear wheels 109', 110' of the vehicle. This pre-determined force may be selected such that the lifting blocks 105, 107 have been driven in beneath the rear vehicle wheels 109', 110' and have lifted the wheels before the force reaches the pre-determined value. When the drive arrangement 151 has stopped, the control circuit activates the piston-cylinder device 135 in a manner to swing the lifting blocks 106, 108 outwardly so that the lifting block pairs 105, 106; 107, 108 of the second carriage 112' are also moved to the position shown in FIG. 9.

The vehicle has now been lifted clear from the supporting surface 111. The control circuit 161 now activates the motor 163 for driving the third carriage.

If the driver of the vehicle has not positioned the vehicle precisely in relation to the first carriage 112, the carriage is displaced relative to the vehicle when the lifting block pairs are swung out, through the medium of the carriage suspension.

The third carriage is arranged to transport the vehicle to a parking space, either directly or via lift arrangements or the like, where the vehicle is removed from said third carriage. The vehicle is removed from the carriage, by swinging all lifting blocks inwardly to their respectively inwardly swung positions.

It will be understood that the vehicle transporting arrangement is also constructed to collect a parked vehicle in a manner corresponding to that aforedescribed, and to deposit the vehicle at a location provided with a drive support surface 111, as illustrated in FIG. 7.

According to said second embodiment of the invention, the first and the second carriages are displaceably arranged in relation to a common third carriage.

FIG. 11 illustrates schematically a third embodiment of the invention, in which those components corresponding to similar components in the FIG. 7 embodiment have been identified by the same reference numerals.

According to this third embodiment, the first carriage 112 and the second carriage 112' are carried on wheels 170 and are driven by electric motors 172, 173 directly on a supporting surface, such as rails. No third carriage is therefore required.

The method of operation of this third embodiment corresponds to the method of operation of the FIG. 7 embodiment, and consequently, the method of operation of said third embodiment will only be briefly described.

A loading sequence begins when the first carriage 112 adopts a pre-determined position relative to the beam paths 164, 165, whereafter the lifting blocks 101–104 are swung outwards. The second carriage 112' is then driven downwards in FIG. 11 through a given distance, whereafter the lifting blocks 105 and 107 are swung outwards. The second carriage 112' is then driven upward n FIG. 11, until a force sensing device produces a pre-determined signal indicating that the lifting blocks 105 and 107 have been moved into pre-determined abutment with the rear wheels of the vehicle. The force sensing device may for example comprise a current sensing device intended to sense the current strength through the motor 173.

When the control circuit receives the aforesaid predetermined signal, the circuit stops the motor 173 and causes the lifting blocks 106 and 108 to be swung outwards.

The control circuit then activates the first, the second or both motors 172, 173 of the carriages in order to drive away the carriages and the vehicle. Both carriages are driven synchronously subsequent to depositing a vehicle.

A distance measuring device 180 of some suitable known kind, e.g. a device which is operated by means of ultrasonic sound or infrared light, may be provided for sensing the distance between the carriages, wherewith only the position of one carriage need be established in relation to the transport path of the carriages by suitable known devices, such as limit switches, inductive sensors, etc.

It will be obvious to those skilled in this art that the carriages and drive arrangements of the aforedescribed embodiments may have different designs to those described without departing from the inventive concept, namely the concept of utilizing lifting blocks which can be swung inwardly and outwardly and which are arranged to be inserted beneath the wheels of a vehicle.

The present invention is thus not restricted to the illustrated embodiments, since modifications can be made within the scope of the following claims.

I claim:

1. A vehicle transporting arrangement, intended for private motor vehicles, by means of which a vehicle, after being driven over and placed on the transporting arrangement, is transported to a parking space in a vehicle parking building, which includes vehicle supporting surfaces, without the assistance of a driver and without the vehicle being rolled on its wheels to such space, wherein the transporting arrangement can be located adjacent said supporting surface, and comprises: eight lifting blocks (1–8; 101–108), adjacent said supporting surface, which are adapted to be placed in pairs on front and rear sides of a respective vehicle wheel; wherein a first and a second lifting block pair (1,2; 3,4; 101,102; 103,104) are included in a first lifting unit (200), and wherein a third and a fourth lifting block pair (5,6; 7,8; 105,106; 107,108) are included in a second lifting unit (201), said first lifting unit including a first carriage (112) and said second lifting unit including a second carriage (112'), said carriages (112,112') being arranged sequentially, one after the other, along a line (C—C) along which a vehicle under power is intended to be initially driven by a driver onto the building supporting surface (111) and said vehicle thereby being placed above the carriages (112, 112') with the longitudinal axis of the vehicle above and parallel with said line; wherein a plurality of arms (113–130), each of which has an associated power means (135), are provided and each lifting block (101–108) is attached to one end of an associated one of said arms (113–120) which is mounted to be swung by an associated said power means (135) about an axle (121–128) connected to respective carriages (112,112') from an inwardly swung position, in which respective arms (113–120) and their associated lifting blocks (101–108) lie substantially parallel with said line (C—C), to an outwardly swung position which is substantially perpendicular to the inwardly swung position, where each pair of lifting blocks is adapted to be driven from its inwardly swung position to its outwardly swung position, whereby each pair of said lifting blocks are moved by associated pairs of said arms to a position in beneath a respective vehicle wheel from both the front and rear sides thereof, thereby to lift said wheel and thereby said vehicle; and wherein the distance between the two lifting block pairs of each carriage (112,112') in the outwardly swung position of said pairs corresponds to the track width of the wheels of a vehicle which is intended to be lifted; and wherein at least one of the carriages (112,112') is mounted so that it is adapted to be displaced along said line (C—C); and said outwardly swung position of the lifting blocks (101–108) of each pair of lifting blocks lie in close proximity to one another; and wherein, when seen in vertical cross-section, the lifting blocks (101–108) have a wedge-shaped configuration such that, when in their outwardly swung position, two mutually co-acting lifting blocks (101–108) define an upwardly concave surface; and a common third carriage (140) is provided to which said carriages (112,112') are mounted and movably connected, whereby said common third carriage (140), is adapted to transport the first and second carriages (112,112') and the vehicle at least along the said surface in a horizontal direction along said line (C—C), said first and second carriages being supported solely on said third carriage.

2. A transporting arrangement according to claim 1, wherein a first of said lifting blocks (101, 103; 105, 107) of both pairs of lifting blocks on a carriage (112; 112') are arranged to be swung synchronously outwards; and in that the second of said lifting blocks (102, 104; 106, 108) of said both pairs of blocks are arranged to be swung out synchronously.

3. A transporting arrangement according to claim 2, wherein said first lifting blocks (101, 103; 105, 107) can be swung independently of said second lifting blocks (102, 104; 106, 108) and vice versa.

4. A transporting arrangement according to claim 1, wherein said first carriage (112) is arranged for limited movement relative to the third carriage (140), said first carriage (112) being held in a neutral position relative to the third carriage (140) by means of springs (149, 150).

5. A transporting arrangement according to claim 1 including the provision of a drive arrangement (151) for moving said second carriage (112') relative to said third carriage (140).

6. A transporting arrangement according to claim 1 characterized in that said two carriages (112, 112') can be driven along the supporting surface on which they are supported.

7. A transporting arrangement according to claim 1 wherein the lifting blocks (101–108) are provided with rollers (136) intended for abutment with the supporting surface when the lifting blocks are raised above said supporting surface (111).

8. A transporting arrangement according to claim 1, wherein said concave surface of said lifting blocks (101–108) is defined by a plurality of rollers (137).

* * * * *